United States Patent [19]

Bean

[11] 3,982,939

[45] Sept. 28, 1976

[54] MULTIPLE LAYER MIGRATION IMAGING SYSTEM

[75] Inventor: Lloyd F. Bean, Rochester, N.Y.

[73] Assignee: Xerox Corporation, Stamford, Conn.

[22] Filed: Mar. 31, 1975

[21] Appl. No.: 563,892

Related U.S. Application Data

[60] Division of Ser. No. 309,546, Nov. 24, 1972, which is a continuation-in-part of Ser. No. 76,891, Sept. 30, 1970, abandoned.

[52] U.S. Cl. ..... 96/1.5; 96/1 PS; 96/1 M

[51] Int. Cl.[2] ..... G03G 5/04

[58] Field of Search..... 96/1.5, 1 PS, 1 M

[56] References Cited

UNITED STATES PATENTS 3,801,314 4/1974 Goffe..... 96/1 PS

*Primary Examiner*—John D. Welsh

[57] ABSTRACT

Images are formed with imaging members comprising one or more migration layers and a softenable layer which may be a circulation layer. An electrical latent image is created on the member with electrostatic charge having a density sufficient to cause migration of the marking material from the migration layer through the migration layer - softenable layer interface and into the softenable layer. When the migration layer and softenable layer comprise materials sufficiently dissimilar so as to retard or prevent penetration, the softenable layer is a circulation layer, the circulation of which enables penetration of the interface by marking material. In a multiple migration layer member, the migrated marking particles have their relative positions inverted.

32 Claims, 11 Drawing Figures

MULTIPLE LAYER MIGRATION IMAGING SYSTEM

CROSS REFERENCE TO RELATED APPLICATION

This is a division of application Ser. No. 309,546, filed Nov. 24, 1972, which is a continuation-in-part of Ser. No. 76,891, filed Sept. 30, 1970 and now abandoned.

BACKGROUND OF THE INVENTION

This invention relates to imaging systems and in particular to a novel migration imaging system utilizing electrophotographic techniques.

Migration imaging systems are described in U.S. Pat. No. 3,520,681 to William L. Goffe and in copending applications Ser. Nos. 837,591 and 837,780 both filed June 30, 1969. In migration imaging migration material imagewise migrates in depth in a softenable material. In a typical embodiment an electrical latent image is created on an imaging member composed of marking particles dispersed in, or layered in, or layered on, a softenable material. Development of this latent image is effected by reducing the resistance of the softenable material to marking particle migration, i.e., it is rendered permeable to the marking particles. Certain marking particles migrate because they associate with the charge of the latent image and the migrated and non-migrated particles constitute complementary images. The complementary images may be separated by various techniques, e.g., the softenable material may be dissolved and washed away, freeing the migrated image but at the expense of losing the non-migrated image. Alternately, the softenable material may be split at a level between migrated and unmigrated particles, thereby freeing both images, as described in copending application U.S. Ser. No. 784,164, filed Dec. 16, 1968, now U.S. Pat. No. 3,741,757.

Several different embodiments of the process are possible by varying the composition of the materials, charging levels, light intensities and other parameters of the process. One embodiment employs photosensitive particles, e.g. selenium, embedded in a layer at or near the surface of a softenable material. This member is uniformly charged and exposed to light in image-wise configuration creating an electrical latent lamp. This latent image need not be characterized by distinct differences in charge density between exposed and unexposed areas as in xerography. The essential mechanism is believed to be that the charge in the exposed areas is capable of becoming associated with adjacent selenium particles at least when the permeability of the softenable material is increased. In this embodiment, typically the selenium particles exposed to light migrate in depth in the softenable material forming a negative image of the original while the non-migrated particles form a complementary positive image. (The terms "positive and negative" images are used in the classical photographic sense with a positive image having areas of light and dark tones corresponding to areas of light and dark tones in an original with the negative image being the inverse of the positive image.)

Another migration imaging embodiment employs an imaging member composed of photosensitive particles randomly dispersed throughout the bulk of a softenable material matrix. This member is uniformly charged and exposed to light in image-wise configuration to create an electrical latent image. Here, the photosensitive particles and/or matrix are capable of dissipating charge from the surface of the member to a conductive substrate in the areas exposed to light. Here the resultant latent image is usually characterized by differences in charge density in exposed and non-exposed areas. The particles adjacent the charged areas associate with the charge and migrate toward the substrate when the permeability of the matrix is increased.

Yet another migration imaging embodiment employs an imaging member having non-photosensitive marking particles on or in a non-photosensitive softenable material matrix. The electrical light image is created by selectively charging areas of the member as through a stencil or by other charge pattern generating or transferring techniques. The marking particles adjacent the charge become associated with the charge and migrate toward a substrate to form an image.

The permeability of the softenable matrix is increased by methods that include exposing it to heat, solvent vapors, solvent liquids and combinations thereof.

Surface deformation imaging systems are described in a paper by R. W. Gundlach and C. J. Claus titled "A Cyclic Xerographic Method Based on Frost Deformation" in *Photographic Sciences and Engineering*, Vol. 7, No. 3, pp. 14–19, Jan. – Feb. 1963. Additional descriptions are given in U.S. Pat. Nos. 3,196,011 to K. W. Gunther and R. W. Gundlach and 3,113,179 to W. E. Glen, Jr. Two distinct surface deformation imaging systems have evolved: relief imaging and frost imaging. Both imaging systems employ a softenable film (hereafter called a deformable material) overcoating a conductive substrate. Surface deformations occur in both relief and frost systems due to electrical forces exerted on the deformable material when its viscosity is reduced. The deformations in relief imaging are highly regular in shape because they are caused by forces lateral to the surface associated with abrupt changes in charge density. The deformations in frost imaging include randomly shaped depressions generally uniformly spaced over an area of the frostable material having constant or continuously charging charge densities above threshold levels for frosting. The threshold level for frosting is presently believed related to such parameters on ion mobility, viscosity, bulk conductivity, surface conductivity and thickness of the frostable material. During the frost deforming process, the frostable material circulates or flows in a manner similar to convection currents. Circulatting action including frost circulation is employed in the present invention to form novel migration imaging processes and imaged members.

U.S. Pat. No. 3,542,545 discloses the frost or relief wrinkling of an electrically photosensitive layer overlying a deformable layer. The electrically photosensitive layer comprises two configurations: (1) a fracturable film of particles which may be disrupted and relocated into valleys or wrinkles on the surface of the deformable layer in its deformed state, and (2) a layer of binder material and particles which does not fracture nor relocate into valleys but which deforms in the same configuration as the underlying deformable layer in its deformed state. However, in both configurations, the particles do not penetrate the photosensitive layer - deformable layer interface, nor do they migrate into the deformable layer, migration is undisclosed.

Copending application Ser. No. 837,591, filed June 30, 1969 which is a continuation-in-part of Ser. No.

634,757 filed Apr. 28, 1967, discloses a migration imaging member comprising a softenable layer having marking material dispersed therein overlying an additional second softenable layer residing on a suitable imaging substrate. This member may be imaged so that the particles migrate from the top softenable layer straight down into the second softenable layer. This member has proven useful for removing background particles retained in the top layer from the imaged particles, migrated into the second layer so as to enhance image clarity, by simply splitting the top and second softenable layers. However, in use, it is preferred that this migration imaging member have materials in the softenable layers similar to one another, such as miscible materials, so that virtually no effective interface exists between the layers to impede, retard or prevent the migration of particles therebeyond. Additionally, by migrating straight into the second softenable layer, the migrating particles do not group and therefore there is no transparentizing or window opening effect.

SUMMARY OF THE INVENTION

Accordingly it is an object of this invention to provide a novel imaging system which is a synergism of migration and circulation.

Another object of the present invention is to enable particles migrating through a softenable matrix to penetrate an interface between the softenable matrix and another dissimilar softenable medium.

Another object of the present invention is to develop novel, high resolution, high contrast migration imaging processes, members, and methods for making the members.

Another object of this invention is to produce photographic reflection images with migration imaging systems.

Another object of the invention is to improve contrast in migration imaging systems.

Another object of this invention is to control the migration in an imaging member by means of a photoconductor into and through which marking particles migrate. The control is exerted by collapsing the field across the photoconductor in the areas it is exposed to light so that migration does not occur where fields are collapsed.

Still another object of this invention is to provide means for making reflection images with migration imaging systems.

A further object is to provide means for insuring that particles migrating to the migration layer - circulation layer interface reach lower portions of the circulation layer.

The above and other objects in the single migration layer embodiments hereof are realized by deliberately causing circulation to occur which provides the unique results of window opening, i.e., a reduction in optical density; grouping of migrating particles either in the lower portions of the migration layer or in the circulation layer; and the assurance that all particles migrated to the migration layer-circulation layer interface will migrate into the circulating circulation layer, down to the lower portions of the circulation layer and upon any substrate which may be adjacent thereto, if process conditions are maintained. When the imaging member, including any substrate included therein, is at least partially transparent, the window opening effect provides a reduction in optical transmission density. When there is either opaqueness or partial transparency in the imaging member, the reflected image can be viewed to see a reduction in optical reflection density.

In the two migration layer embodiments hereof, the migration particles from the outermost layer are positioned beneath the migration particles in the inner migration layer; i.e., inversion of the relative positions, for example, of white and black migration particles takes place and creates a high contrast image. Circulation of the circulation layer can be effected to produce results as in the single migration layer case and to attain the objectives noted above. More than two migration layers can be provided in the imaging member of the invention.

The novel imaging members of this invention include one or more migration layers comprising marking particles and softenable material over a circulation layer. Broadly, the circulation layer provides added thickness to the migration layer to make room for significant circulation to take place and to provide space for receiving the migrating migration particles. To satisfy these and similar functions the circulation layer can be made from the same material as the softenable material. Notably, many materials suitable for frost imaging are also suitable as the softenable matrix in a migration member. Consequently, the circulation layer may be denoted by a change in marking material concentration or marking material composition rather than dissimilarities in the softenable material and circulation layer. However, the fabrication and operation of the present imaging members are enhanced by selecting different compositions for the softenable material and circulation layer.

The process steps of this invention include creating an electrical latent image on the free surface of the novel imaging member and developing this image by softening the migration and circulation layers by exposing them to heat, solvent liquid or solvent vapors or combinations thereof; or developing by wash-away techniques as disclosed in previously mentioned copending application Ser. No. 837,591 filed on June 30, 1969. The developing step both increases the permeability of the softenable material to particle migration and reduces the viscosity of the circulation layer to allow circulation. The charge comprising the latent image is above the circulation threshold level at least for the circulation layer. The charge of the latent image associates with marking particles causing them to migrate (usually toward a substrate and preferably a conductive substrate supporting the circulation layer). The circulation enables the migrating particles to more readily penetrate the interface between the migration and circulation layers and enables the migrating particles to penetrate the interface between migration and circulation layers of dissimilar materials where penetration would not occur under imaging conditions without circulation. The particles may then migrate in the circulation layer. The circulating motion within the circulation layer accumulates the migrating particles into groups. If the circulation layer and softenable material are transparent the optical density of the imaging member is greatly reduced in the areas occupied by the migrating, grouping particles. Alternately, the imaging member components may be different colors resulting in a color change in reflection viewing of the imaging member following migration; for example, a magenta particle migrated out of a green binder yields green in migrated areas upon reflection viewing whereas no apparent color change is detected upon transmission viewing.

In embodiments of the present invention utilizing a deformable circulating layer, i.e., a softenable, deformable layer under the migration layer or layers, the softening may be carried to the point where the deformations to the imaging member caused by the circulation pass a maximum condition and the imaging member resumes its initial shape and is without deformations. The circulating action and not the resulting deformation is the important result in the deformation embodiments of this invention. This takes the deformation process criticality of development out of the present process since there is no substantial danger in oversoftening the imaging member. Materials other than frostable or deformable materials may be used in the circulation layer provided they circulate in response to a charge density. The charge density at which the circulation layer begins to circulate is herein referred to as the threshold level of circulation. The threshold level for circulation and that for deformation may coincide for some deformation materials.

DESCRIPTION OF THE DRAWINGS

Other objects and features of the present invention will be apparent from a further reading of the specification and from the drawings which are.

DESCRIPTION OF THE PREFERRED EMBODIMENTS

Figure 1A:
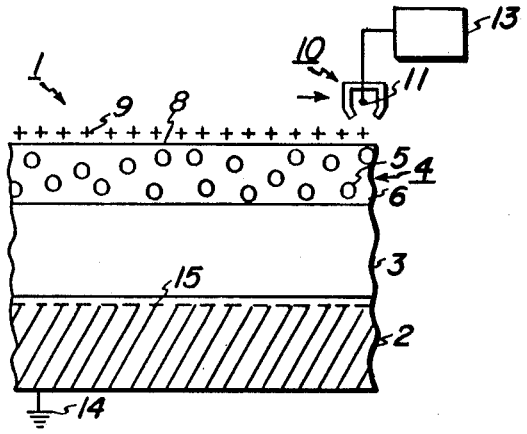
FIGS. 1A–D are partial schematic illustrations of a cross-section of an embodiment of an imaging member according to this invention and illustrate steps for forming an image.

The disclosures of the above identified patents and articles are hereby incorporated by reference into the present specification for purposes of describing migration and deformation imaging methods, the materials used therein and the methods of making the materials and members used in the methods.

This invention represents the first successful marriage of the migration imaging process with the circulation phenomena of deformation imaging. The circulation action associated with the deformation processes is employed to alter the flow of migrating particles by displacing them laterally and accumulating them into groups during circulation, the groupings usually being spaced in the familiar uniform fashion of frost deformation or the edge fashion of relief deformation. In the circulation embodiments of the present invention only the circulation is sought and not the deformation itself. Although the final developed member may in fact be or have been during the imaging process deformed both internally and externally, it need not be. Any softenable material which will circulate will suffice, even though it does not deform; for example, silicone oil. The circulation action is also beneficial for enabling the migrating particles to penetrate the interface between migration and circulation layers especially those that are dissimilar enough, such as immiscible, to retard or prevent migration therethrough without circulation. The circulation sometimes gives rise to deformations at the interface which are herein characterized as "peaks" and "valleys." It is believed that circulation is what causes accumulation of migrating particles into groups in the vicinity of the interface where two or more circulation effects amplify each other to create a valley such as arrows 110 and 111 in FIG. 1C. It is thought that the forces urging migration of the marking particles are amplified when the particles are grouped or concentrated and that consequently the particles are able to penetrate the interface and be deposited in groups at the lower portion of the circulation layer.

The degree of dissimilarity which calls for circulation in accordance with the present invention is any dissimilarity which prevents the migration of migrating particles from the migration layer or layers and into the circulation layer under imaging process conditions in the absence of the circulation layer circulating. In this regard, immiscible layers or materials are an example of the degree of dissimilarity which calls for circulating the circulation layer. "Immiscible layers or materials" are used herein to include two or more layers or materials which can be cast such that a distinct interface or interfaces, including viscosity gradients, exists therebetween even though the layers or materials can be cast to have no distinct interface or interfaces under other conditions; and include materials which initially have a distinct interface but which diffuse into one another either in time or under certain conditions outside those in the imaging process.

FIGS. 1A–D are helpful in explaining the results produced by the present invention and the mechanism currently believed responsible for that result. The imaging member 1 of FIGS. 1A–D includes a substrate 2, a circulation layer 3 and a migration layer 4. The substrate is preferably a conductive material but can be an insulating material or a combination of both such as a thin conductive layer over an insulating layer. The substrate may be mechanically rigid or flexible, transparent or opaque depending upon the needs of a particular imaging system.

The circulation layer 3 is composed of softenable material capable of having its viscosity decreased sufficiently to allow electrical forces to circulate it. The viscosity is reduced by methods including subjecting the material to heat, solvent vapors, solvent liquids or a combination thereof. The materials normally exhibit good electrical insulating properties and may optionally be deformable materials.

The migration layer 4 includes marking particles 5 and softenable material 6 which is a matrix or binder. The marking material 5 may be continuous or particulate; but if continuous, should be "fracturable." By fracturable is meant that the marking material is capable of being broken up into particles before or during the image forming process. It is not necessary for the marking particles to have any particular property but preferably they (and/or the softenable material) are photosensitive to aid in creation of the electrical latent image. The marking particles may be a mixture of particles composed of different materials and different colors and are typically included in sufficient quantities to render the imaging member 1 substantially opaque. The softenable material is commonly transparent but may include a dye or other colorant. The softenable material is capable of having its resistance to migration of marking particles through its bulk reduced. Another way of saying the same thing is to characterize the softenable material as being capable of having its permeability increased to permit migration of the marking particles through its bulk. The reduction in resistance or increase in permeability is accomplished by subjecting the softenable material to heat, solvent vapors, solvent liquids or combinations thereof. Of course, the softenable material should be electrically insulating at least in the dark to retain the electrostatic charge comprising the latent image.

The first step in the present method is to create an electrical latent image on the free surface 8 of the migration layer. As indicated earlier, this may be accomplished by a wide variety of methods including charging through a stencil, electrostatic transfer of charge and charge induction methods. Preferably, the migration layer is photosensitive enabling the latent image to be formed by charging and exposing steps. In FIG. 1A the plus signs 9 represent positive ions generated by the corotron 10 and deposited on surface 8 as the corotron is passed over the imaging member. The corotron includes a thin conductive wire 11 coupled to a suitable high voltage source 13. The substrate is coupled to ground 14, by way of example, and the electric field between substrate 2 and wire 11 permits ionization of air around the wire causing an ion current flow. Modes of electron charging may also be used. In the case illustrated, the negative ions and electrons are attracted to wire 11 and the positive ions flow toward substrate 2 coming to rest on the insulating migration layer 4. The positive ions induce negative charge in the substrate 2 represented by the minus signs 15. The particular charge polarities are given as examples only and it should be understood that the opposite charge polarities may be employed. However, charge of one polarity may be preferred over that of opposite polarity depending on the materials used in the imaging member. If the migration layer is more efficient in transmitting holes than electrons, positive charge may be preferred to negative charge and, similarly, negative charge may be preferred if the migration layer is more efficient at transmitting electrons.

Figure 1B:
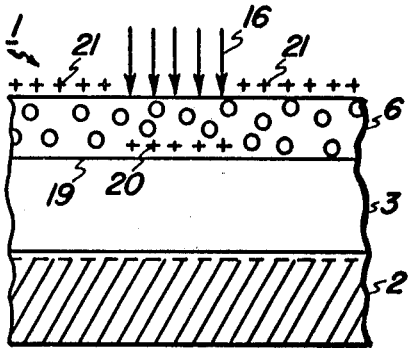

FIG. 1B illustrates a charged imaging member after it is exposed to a pattern of activating electromagnetic radiation, e.g. light in and near the visible spectrum. The lines 16 represent activating radiation in imagewise configuration that acts on the migration layer to render it capable of transporting the charge 20 in the exposed areas to the interface 19. (Exposure may be through the substrate if it is transparent.) The charge 20 stops at the interface 19 because the circulation layer in this embodiment is electrically insulating. (The circulation layer may be conductive, at least in light.) The charge 21 remaining on the free surface of the migration layer constitutes the electrical latent image for this embodiment.

Figure 1C:
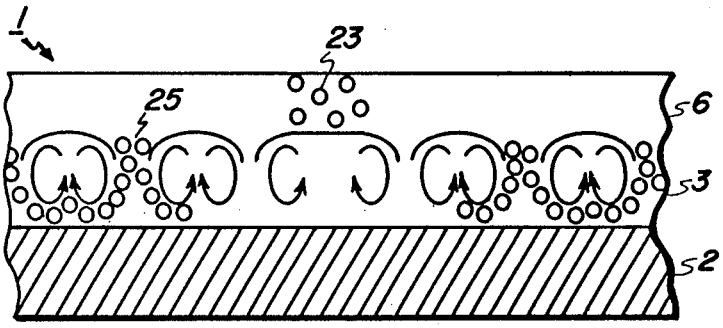

The electrical latent image 21 is developed by reducing the resistance of softenable material 6 to the migration of the marking particles and by reducing the viscosity of the circulation layer to permit circulation. The effect of the development step on the imaging member is illustrated in FIG. 1C and is accomplished by exposing the imaging member to heat, solvent vapors, solvent liquid or combinations thereof, or by the previously mentioned wash-away techniques. The marking particles 22 migrate toward substrate 2 because, as it is presently understood, they become associated with the charge 21 as that charge is attracted toward the substrate through the softened imaging member. The marking particles 23 do not migrate substantially because they are not in the path of migrating charge since charge 20 of FIG. 1B was transported by photoconduction through the imaging member to interface 19 before the development step.

The deposited charge is of sufficient magnitude to cause circulation to occur, i.e., it is above a circulation threshold level. Initially, charge 9 was distributed over the imaging member but after the exposure to light, charge 20 migrated closer to substrate 2. The movement of a fixed quantity of charge closer to charge of opposite polarity results in a reduction of potential as is apparent from the equation for charge $Q=VC$, where $V$ is the potential difference between the charges on either side of an insulator and $C$ is the capacitance of the structure. The reduction in voltage is not significant, however, because the total charge $Q$ remains substantially the same because the reduction in voltage is balanced by an increase in capacitance. The point is that the electric field, i.e., charge density, remains substantially constant across the circulation layer in exposed and non-exposed areas because no significant quantity of charge is dissipated. Consequently, when the viscosity of the circulation layer 3 is reduced in deformation embodiments of this invention, deformation occurs generally uniformly across the entire interface 19. (Some deformation of the free surface 8 may also occur.) This points out a distinctive feature of this invention; namely, the deformation need not occur over limited areas of the imaging member in the deformation embodiment of the invention as with prior deformation imaging methods. A reason for this difference is thought to be that the circulation of the circulation layer associated with the deformation enables the migrating particles to escape their initial medium and causes grouping of the particles during migration. After the migration has taken place in deformation embodiments of the invention, the viscosity may be reduced to restore the initial plane shape of the interface 19 and free surface 8 since the location of the marking material and not the deformation is the primary means for rendering the latent image visible. The amount of circulation and therefore the degree of particle accumulation are relative and both can be controlled by varying the charge density. Some circulation may be required for the particles to penetrate the interface in some embodiments of the invention, such as when the circulation layer comprises a deformable material or when the circulation layer and softenable material are not similar materials. Some circulation is essential for the grouping of particles in the migration layer or layers and in the circulation layer.

Figure 2:
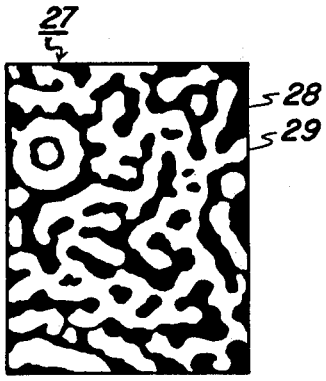
FIG. 2 is a drawing of an enlarged photograph of a plan view of the deformation pattern created on a frostable material subjected to uniform charge density above a frost deformation and thus circulation threshold level.

The member 27 in FIG. 2 is a frostable material layered over a conductive substrate. A uniform charge pattern was deposited onto the member with the density of the charge being above the threshold level required for initiating the circulation of the frostable material and the resultant deformation. The deformation pattern is characterized by a plurality of irregularly shaped depressions or valleys 28 separated from each other by peaks 29. A close examination of the depressions indicates that there is some uniformity to the spacing between them which is generally equal to two times the thickness of the frostable material. Irregularity in the material, its thickness and imperfection at its surface are believed to be some of the factors causing the shape of the various depressions to vary.

The pattern representing the deformation of interface 19 of FIG. 1B in FIG. 1C during circulation is intended to approximate the phenomena of circulation in cross-section. The pattern resembles a truncated double rectified sine wave pattern. A similar deformation pattern of the free surface 8 may also occur either because of circulation set up in the migration layer and/or because the migration layer is thin enough to assume the shape of circulating circulation layer 3. This is also applicable to similar interfaces and free surfaces, such as those of FIGS. 3B, 4C and 5B.

The accumulation of migrating particles in the vicinity of valleys or depressions, such as depressions 25 in FIG. 1C, may be explained by several reasons. One reason is believed to be that the charged particles seek the path of least resistance in their attempt to reach the negative charge 15. It is easier for the particles to move in their original medium than it is to cross the interfacial barrier 19. Therefore, the particles move into depressions 25 to remain in the softenable material while approaching the substrate charges. Another reason is believed to be that the particles are laterally displaced by the mechanical agitation associated with the circulation. Another explanation is that the softening is continued to the point where the viscosity is so low that the circulation layer material flows back together and surrounds the particles in the vicinity of the low areas near interface 19. Whatever the explanation, penetration occurs when charge density above the threshold levels for circulation are used; and the density of imaging member 1 is reduced at least to some degree in the areas of migration. The accumulation of particles can effectively erase the migrated image to the human eye but in so doing renders the unmigrated image immediately available for projection or reflection viewing.

Figure 1D:
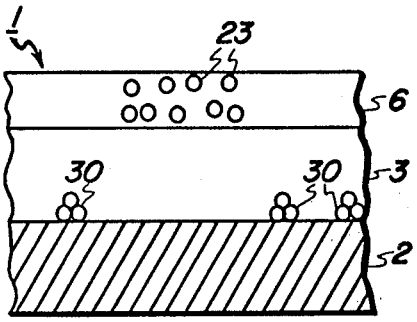

Circulation is normally limited, though it need not be, primarily to within the circulation layer, thickness and extending to the vicinity of its interface with the migration layer; usually creating some secondary circulation with a concomitant grouping effect on the migrating particles within the migration layer and near said interface. The migration of marking particles may be stopped at this point using techniques such as uniform exposure to actinic radiation as disclosed in copending application Ser. No. 695,238 filed Jan. 2, 1968 and hereby incorporated by reference. In such case the migrated particles never substantially leave the migration layer but the member, for example member 1 of FIG. 1, is nonetheless rendered less opaque because the particles are accumulated into spaced groups thereby reducing the optical density, whether transmission or reflection images are viewed. In cases where the circulation layer is photoconductive uniform exposure to radiation actinic to both the migrating marking particles and circulation layer will stop both migration and circulation by collapsing the electric fields within both the migration and circulation layers. Care should be exercised in cases where only migration but not circulation is stopped to insure that the migrating particles are stopped prior to being irrevocably within the grasp of circulation and its effects. Alternately, the developing process may be continued to the point where the marking particles penetrate the interface 19, move into the circulation layer 3 and continue migrating toward charge 15 as depicted in 1C. The marking particles are able to migrate through the circulation layer material since its viscosity is sufficiently reduced. The particles apparently tend to migrate in groups that were formed in the depressions 25. FIG. 1D represents the case where development is continued until marking particle groups 30 reach the substrate and the planar shape of the interface 19 is restored.

There is no upper time limit on the development or softening step for the present imaging members. Generally even the unmigrated particles e.g., particles 23 in FIGS. 1C–D, have some net charge associated with them and are attracted toward the substrate. This inchoate charge is negligable in comparison to that imparted to particles by the electrical latent image. With passage of time, even particles 23 will succeed in migrating to the substrate or at least to the interface 19. The image formed by particles 23 is not adversely affected, however, because the original migrating particles are accumulated in groups, e.g. groups 30 in FIG. 1D, and effectively open a window in the imaging member. The circulation layer material, which is a softenable material and may be a deformable material, may be opaque and a different color from the marking particles so that a high contrast reflection image is obtained rather than using the window opening effect to create a transparency. Both effects can occur simultaneously. For example, if a migration layer contains titanium dioxide marking particles and resides upon a colored circulation layer such as a photoconductive one containing phthalocyanine particles; after imaging, when viewed from the migration layer side the image is white in exposed, unmigrated areas and blue in unexposed, unmigrated areas. Viewed from the circulation side, the image is dark blue in exposed, unmigrated areas and a light transparentized blue in unexposed, migrated areas.

Figure 3A:
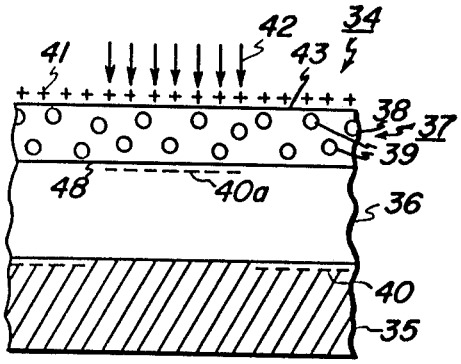
FIGS. 3A–B are partial schematic illuatrations of a cross-section of another embodiment of an imaging member wherein the circulation layer is photosensitive.
Figure 3B:
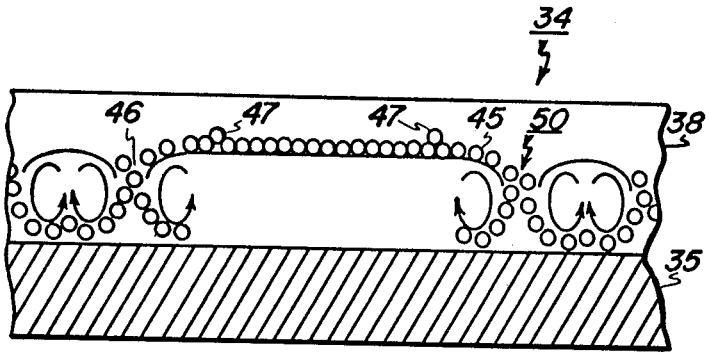

An embodiment represented by the schematics in FIGS. 3A–B differs from that of FIGS. 1A–D in that the circulation layer is photoconductive. This embodiment illustrates the case where a frostable photoconductive layer acts as a valve or gate to control migration. It also controls circulation. Imaging member 34 includes substrate 35, circulation layer 36 and migration layer 37. The substrate includes a conductive member such as transparent glass plate coated with a transparent conductive layer of tin oxide. The circulation layer includes a frostable material rendered photoconductive by known techniques. For example, adding 2,5-bis (p-aminophenyl)-1,3,4-oxadiazole available under the trademark TO 1920 from Kalle and Co., Weisbaden - Biebrich, Germany to Vinylite VYNS, a copolymer of vinyl chloride and vinylacetate available from Union Carbide Plastics Co., or, adding 2,4,7-trinitro-9-fluorenone to polyvinyl carbazole, available under the trademark Luvican 170 from Winter, Wolff and Co. New York, New York. Similarly photoconductive dyes may be added to suitable circulation layer materials to broaden the circulation layer spectral response; such as, for example, the addition of Rodamine B dye, a red water-soluble dye available from DuPont, to either TO 1920 and Vinylite VYNS or VYLF (another copolymer of Vinylchloride and vinyl acetates). The circulation layer also may be rendered photoconductive by adding photoconductive particles in sufficient quantity. The migration layer includes a softenable material 38 and nonphotoconductive particles 39. FIG. 3A illustrates member 34 before and after exposure to activating radiation. Ths plus signs 41 represent charge uniformly deposited over the surface of member 34 as with corotron 10 while the negative signs 40 represent equal and opposite negative charge induced in the substrate. The lines 42 represent activating radiation in imagewise configuration that renders the circulation layer conductive. (Exposure can be made through the transparent substrate.) The negative charge 40A is transported to interface 48 in the exposed areas thereby collapsing the electric field across the circulation layer. Here the electrical latent image is characterized by the charge pattern at the interface 48.

When the charged and exposed member 34 is developed the particles 45 adjacent the nonexposed areas migrate toward the substrate and are accumulated into groups 50 in the vicinity of penetration sites 46. The particles 47 migrate to the interface 48 but no further because the field is collapsed across the circulation layer in the exposed areas. The collapse of the field across the circulation layer in the exposed areas also explains why particles 47 are not significantly accumulated because the frostable circulation layer is not circulating in areas under exposure 42 but is circulating in non-exposed areas. The developing causes the groups 50 in non-exposed areas to reach the substrate and the planar shape of interface 48 is restored making member 34 similar to the imaging member shown in FIG. 1D.

Figure 4A:
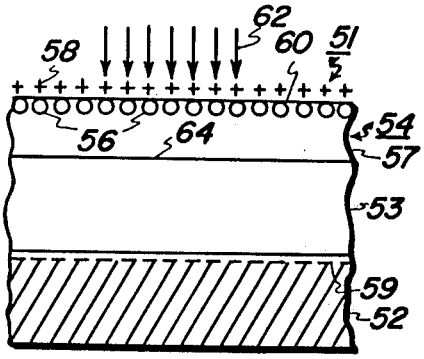
FIGS. 4A–B are partial schematic illustrations of a cross-section of another embodiment of an imaging member wherein the marking material are particles arranged in a layer and wherein exposed marking particles migrate.
Figure 4B:
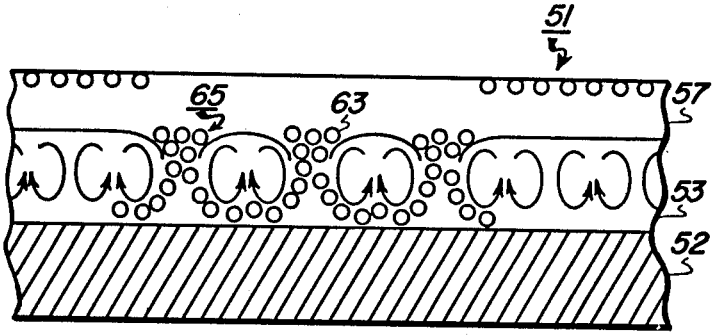

An embodiment represented by FIGS. 4A–B differs from the prior discussed embodiments in that the marking material is layered rather than dispersed in the softenable material of the migration layer. The imaging member 51 includes the conductive substrate 52, circulation layer 53 and migration layer 54. The migration layer has photosensitive particles 56 comprising the marking material arranged in a layer near the surface of softenable material 57. The plus signs 58 and minus signs 59 represent the charge deposited on the surface 60, as with corotron 10, and induced in the substrate, respectively. The lines 62 represent activating radiation in imagewise configuration that acts on the marking material in a manner making them more capable of associating with the charge than the particles in the unexposed areas thereby defining the electrical latent image. During development, particles 63 in the exposed areas acquire sufficient charge for migration while the non-exposed particles remain in the layer. At development, charge is across the entire circulation layer causing circulation substantially uniformly along the entire interface 64. The migrating particles 63 accumulate into groups 65 thereby reducing the density of the image represented by them. The development may be stopped while the migrating particles are in the migration layer as previously described or continued until the groups 65 reach the substrate as illustrated in FIG. 1D and the initial planar shape of interface 64 is restored.

The magnitude of deposited charge employed in the embodiment represented in FIGS. 4A–B should be selected with care when certain photoconductive particles, such as selenium, are used as migration particles and which will migrate in both exposed and non-exposed areas depending upon exposure and charge levels. The potential gradient across (or charge density over) the imaging member is preferably above the threshold level for circulation but below the level causing all of such particles to migrate. These certain particles will migrate in exposed areas when the deposited charge is sufficient to cause circulation in the circulation area but not sufficient to cause migration until the particles are exposed. The exposure causes the surface charge to become associated with these particles which in turn causes migration of the exposed particles upon development of the imaging member. If the charge is increased above this value but the exposure not increased, all particles will migrate but the exposed particles will migrate at a faster rate than the unexposed particles and will reach the circulation layer first. At this point, migration of the unexposed particles may be halted in the migration layer as previously described leaving the exposed particles imagewise configured in the circulation layer. The imaging member may be stripped or split to render a visible image as described in U.S. Pat. No. 3,664,834 hereby incorporated by reference. When the amount of deposited charge is sufficient to cause migration of unexposed particles, selective migration of unexposed particles can be effected by increasing the exposure so that the electric field across the migration layer in exposed areas collapses and thereby prevents the migration of exposed particles.

Figure 5A:
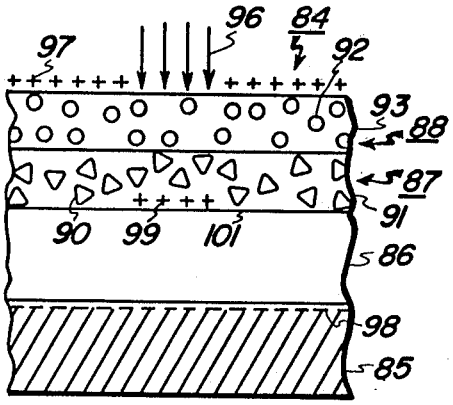
FIGS. 5A–B are partial schematic illustrations of a cross-section of an imaging member having two different colored migration layers over the circulation layer and illustrate the member at exposure and after development.
Figure 5B:
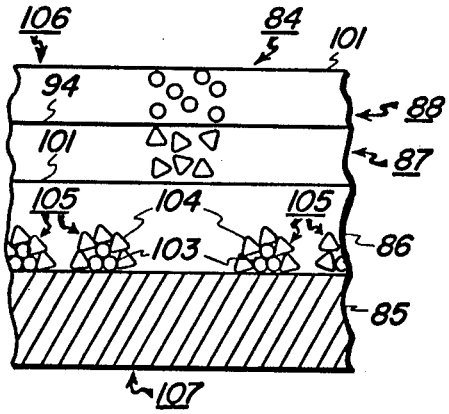

The embodiment represented in FIGS. 5A–B differs from the above in that multiple migration layers are coated over a softenable layer. As in previously described embodiments of the invention, circulation is preferred when the softenable material in the softenable layer (circulation layer of previous embodiments) and that in the adjacent migration layer are sufficiently different, such as immiscible, so as to have an interface therebetween which retards or prevents migration therethrough. Accordingly, when these layers do set up such an interface, it is preferred that the softenable layer be a circulation layer in which circulation can occur. Further, a very surprising inversion of the marking particles takes place. It is believed that the marking particles in the outer migration layer acquire comparatively more charge than those in the inner migration layer, giving rise to unequal migration rates. Circulation though not always necessary, if present, is also believed to assist in this inversion in addition to enabling interface penetration by marking particles and causing window opening by grouping the marking particles. Imaging member 84 includes a conductive substrate 85, circulation layer 86, inner migration layer 87 and outer migration layer 88. The inner layer 87 includes the photosensitive particles or pigments 90 and a first softenable material 91. The outer migration layer includes photosensitive marking particles 92 and a second softenable material 93. The softenable materials 91 and 93 may be the same with no real interface such as interface 94 existing between them. The interface 94 is shown primarily to indicate a separation between the marking particles 90 and 92. FIG. 5A illustrates the imaging member during or after exposure to activating radiation in imagewise configuration represented by the lines 96. The plus signs 97 and minus signs 98 represent deposited and induced charge, respectively. Charge 99 migrates from surface 100 to interface 101 as a result of the exposure to the radiation and together with the unmigrated charge cause circulation along the entire interface 101. When member 84 is developed particles 92 in the nonexposed areas migrate toward the substrate passing the pigments 90 in the nonexposed areas which also migrate. Both particles 92 and 90 are collected in groups by the circulating action when circulation is effected.

FIG. 5B illustrates an embodiment of multiple migration layers according to this invention where circulation was effected. When member 84 is developed, both the particles 90 and 92 in the nonexposed regions migrate toward the substrate. The circulation, it is believed, assists the outer most particles 92 in reaching the substrate before the innermost particles 90. FIG. 5B illustrates the situation where development has continued to the point until the initial shape of interface 101 is restored. The circulation caused the migrating particles to form into spaced groups 105. Each group consists of migrated particles 103 from layer 88 covered by migrated particles 104 from layer 87.

The developed imaging member of FIG. 5B is unique. The substrate, softenable materials and circulation layer are transparent and the particles in the outer migration layer are white, or a light color, and the particles in the inner layer are black, or a dark color. When member 84 is viewed from side 106 with light directed onto surface 106, the light is reflected off white particles in exposed areas and is either transmitted or absorbed by black particles in the nonexposed areas. The transmission occurs because both the black and white particles are accumulated into groups 105 lowering the optical transmission density in the unexposed areas. The absorption occurs because the black particles are covering the white particles due to the inversion. The resultant image is a positive reflection image exhibiting high contrast between the exposed and non-exposed areas. When member 84 is again viewed from side 106 but with light directed onto side 107, the light is transmitted only or primarily in the nonexposed areas where the groups 105 are formed and the resultant image is a negative transparency.

When the member 84 is viewed from side 107 with light directed at side 107, some light is reflected by the white particles in the groups 105 and is absorbed or transmitted in all other areas. The resultant image is a negative reflection image. When member 84 is viewed from side 107 with light directed onto side 106 the viewer sees light transmitted between groups 105 and the resultant image is a negative transparency.

In the embodiment of FIGS. 5A and B, both the inner and outer migration layers 87 and 88 are photoconductive. The above described results are nonetheless still obtainable when one or neither of the migration layer is photoconductive and, the electrical latent image is created by some technique other than charging and exposing. Substantially the same results as illustrated in FIG. 5B are obtainable, however, when the externally created electrical latent image is developed. In this case, little or no circulation or migration occurs in the areas of low charge density.

When the outer migration layer 88 is photoconductive but the inner layer 87 is not, charging, exposing and developing yields a different result than that shown in FIG. 5B. In this case, all the particles in layer 87 migrate because the charge in the exposed areas is stopped at surface 94 (assuming the softenable material of layer 87 is insulating). The developed member is functionally similar because the particles 90 in the exposed areas still occupy the same position relative to particles 92 in the exposed areas although they have migrated and circulation may have reduced their optical density. An example of this embodiment is when particles 92 are zinc oxide and particles 90 are carbon black.

When the inner migration layer 87 is photoconductive but the outer layer 88 is not, charging, exposing and developing yields only a minor difference from that shown in FIG. 5B. The minor difference is that particles 92 in the exposed areas migrate to the interface 94 between the two migration layers. These particles do not migrate further because the exposure collapses the field in the photoconductive inner layer. This operation is of course dependent upon the outer layer (or substrate and circulation layer) being sufficiently transparent to allow radiation to reach the inner layer.

The embodiments wherein none of the layers in the imaging member is photoconductive may be represented by the schematics of FIGS. 3A–B by eliminating exposure lines 42 and visualizing that particles 47 do not migrate. The charge 41 is deposited on the member in imagewise configuration thereby creating the electrical latent image. Any one of the several techniques may be used as, for example, stencil charging. A conductive shield having cutouts in the shape of the image is spaced above layer 37 (FIG. 3A). The substrate is coupled to ground and the conductive shield to a potential near that to which the surface 43 is to be charged. A corotron coupled to a higher potential is passed over the conductive shield depositing charge on surface 43 in the areas of the cutouts. Development of the above created electrical latent image results in migration and circulation only in the regions of charges.

All the various imaging members of this invention may have a thin transparent protective coating. The protective layer provides a mechanical and chemical shield for the member and has been demonstrated to increase the shelf life of many photosensitive particles used in the imaging members. A specific example of extended shelf life is an imaging member with an outer migration layer of zinc oxide marking particles overcoated with a thin layer of the same material as the softenable material.

In substantially all the above described imaging members, the substrate, the circulation layer and the softenable materials are all transparent so as to yield a transparentizing "window opening" effect in the migration areas. The window opening may also be used to expose some different color material such as the substrate, circulation layer or softenable material. The softenable material can be colored by adding a dye or other colorant. The circulation layer can be colored by dyes or other colorants including pigments. The substrate may be any colored member.

Other embodiments of the present invention may include various combinations of the above described embodiments.

The partial schematic illustrations of the imaging members before, during and after development are not to scale; but rather, illustrate the structural and functional relationships between the marking particles, migration, circulation and substrate layers, the circulation phenomena and the deformations in deformation embodiments of the invention. It will be appreciated of course, that actual deformation patterns are more complex than those illustratively depicted.

All of the above imaging members may be fabricated by dissolving the softenable material of the circulation layer in a first solvent and coating the solution onto the substrate. The solution is metered onto the substrate, e.g., by a gravure roller, to obtain a uniform thickness. The solvent is then evaporated leaving a solid circulation layer behind. Next, the migration layer softenable material is dissolved in a second solvent for the softenable material yielding a solution to which the marking material is added in suspension. The solvent for the softenable material of the migration layer should not substantially effect the circulation layer. The suspension of marking particles in a solution of a softenable material is then coated by a gravure roller onto the circulation layer. The solvent is evaporated, leaving a migration layer overcoating a circulation layer with a generally plane shaped interface separating the circulation and migrating layers.

If a structure similar to that in FIGS. 5A–B is to be made, the additional migration layer is coated on top of the first migration layer of softenable material and particles. It does not matter that the solvent acts on the earlier coated migration layer since the marking materials of the respective migration layers do not substantially intermix. Where intermixing needs to be avoided, for example when the circulation layer is Piccotex 100 or similar materials, the migration layers may first be coated upon a surface providing easyl release such as Tedlar or silicon treated surfaces. The migration layer is then transferred from the easy release surface to the Piccotex 100 coating while the latter is at about 60°C. The second migration layer is coated onto the first migration layer in the same manner.

The structure of FIGS. 4A–B is fabricated differently in that the marking material is not placed into suspension with the dissolved softenable material in forming the migration layer. The solution of softenable material is coated onto the circulation layer and the solvent is evaporated. This member is then impregnated with the marking material by means that include softening the softenable material of the migration layer to a limited depth.

In the above fabrication techniques, care should be given to the selection of materials for the preferred imaging members involving circulation. First of all, the softenable material of the circulation layer is preferably, though need not be, immiscible with the softenable material of the migration layer. Also, the solvent for the softenable material of the migration layer must not dissolve the softenable material of the circulation layer during fabrication and both materials should be softenable during imaging preferably by a common agent such as heat, solvent vapor or solvent.

The marking material particles, diameters and layer thicknesses have the same limitations generally found in migration and deformation imaging systems. Satisfactory thicknesses for the circulation layer are from about 1 micron to about 12 microns; preferred, from about 1 micron to about 5 microns. Satisfactory thicknesses for the migration layer or layers are from about 0.5 micron to about 5 microns; preferred, from about 0.5 micron to about 2 microns. A preferred volume ratio of particles to binder in the migration layer or layers (other than the FIG. 4 embodiment) is from about 1:8 to about 7:1, the preferred weight ratio being from about 1:6 to about 4:1. Average particle diameters for the marking or migration particles are from about 0.1 micron to about 1 micron. Satisfactory parameters outside these ranges and optimum parameters within these ranges can be found with particular combinations of materials. For most softenable materials in the circulation layer, a satisfactory charge density at or above the threshold level of circulation thereof is one which produces an electrical field strength within the range of from about 10 volts per micron to about 80 volts per micron across the thickness of the circulation layer; a preferred range is from about 30 volts per micron to about 50 volts per micron. Imaged resolutions of up to about 180 line pairs per millimeter have been obtained during the practice of this invention. One exception from the size limitations generally found in migration and deformation imaging is that the migration layer in this system need not be more than one particle size thick. One reason is that the circulation layer provides ample space for the migrating marking particles. The circulation mechanism generally requires that the circulation layer be sufficiently thin so that the charge density required to initiate circulation will not cause dielectric breakdown. Further, the resitivity of the circulation layer should be sufficiently great so that ohmic discharge does not occur before elapse of the development time for the imaging member. It has been empirically found that development time for the imaging members disclosed herein can be approximated by the factor $N10^{-4}$ sec poise where N is the viscosity in poises of the softenable material of the circulation layer. Accordingly, since viscosity is temperature dependent, the selection of softenable material for the circulation layer, when circulation thereof is sought, is made with a view of contemplated process variables such as charge density levels, operating temperatures, the circulation layer viscosity at such temperatures and the circulation layer resistivity.

The following examples further specifically define the present novel imaging system, its materials and methods for making the imaging members. The parts and percentages are by weight unless otherwise indicated. The examples below are intended to illustrate various preferred embodiments of the instant invention. The image multiple layered imaging members herein may have softenable material removed from one or more layers by immersion in discreet kerosene fractions such as Sohio Odorless Solvent 3440, Sohio Odorless Solvent 3456 and other discreet kerosene fractions. Furthermore, the background removal and splitting techniques described in the previously mentioned copending application U.S. Ser. No. 784,164 and U.S. Pat. No. 3,664,834 may be utilized after imaging according to the instant invention to split apart or to remove the migration layer from the circulation or lower softenable layer (or vice versa) or to split apart migration layers or to cause one migration layer to be removed as by washing away or abrasion and other modes taught therein.

EXAMPLE 1

The member 1 in FIG. 1 is prepared in the following manner. The substrate is prepared with a 3 mil "Mylar" film, available from E. I. DuPont, vacuum coated with a thin layer of aluminum that forms an opaque high reflective conductor. The circulation layer is made from a copolymer of n-butylmethacrylate and polystyrene. The copolymer is dissolved in toluene and the solution is coated onto the aluminum layer to yield approximately a 5 micron layer upon drying. The migration layer is made with a polyterpene resin, available from Tenneco Corporation under the trade name "Nirez 1085." The "Nirez" is dissolved in kerosene and the marking material is dispersed in the solution. The marking material is phthalocyanine particles of diameters ranging from about 0.1 to about 1 micron and are mixed with the "Nirez" in a 3 to 7 ratio by weight. The dispersion is coated onto the copolymer circulation layer to yield an approximately 2 micron layer upon drying.

The imaging member has positive charge deposited on it to a value of about 0.2 microcoulombs per $cm^2$ using a corotron described by Vyverberg in U.S. Pat. No. 2,836,725. The charged structure is exposed through the "Nirez" layer to radiation generated by a tungsten lamp (at about 3400°K) passing through a transparency giving an exposure of approximately 0.1 foot candle seconds at the charged surface.

The charged and exposed imaging member is developed by subjecting it to heat. The member is placed on a hot plate at approximately 250°F for approximately two seconds. During the heating period the phthalocyanine particles in the nonexposed areas migrate through the migration and circulation layers to the aluminum layer. The migrated particles are accumulated into spaced groups causing the member to exhibit a distinct reduction in optical density in the non-exposed areas. The member constitutes a high contrast negative reflection image when viewed and illuminated from the "Nirez" side. The member is silver in non-exposed, migrated areas and is blue in exposed, non-migrated areas, and has an imaged resolution of about 100 line pairs per millimeter.

EXAMPLE II

An imaging member is prepared in the same manner as in Example 1 except the marking particles here are mercuric sulfide of approximately the same average diameter and in a ratio of about 8 to 2 by weight HgS to Nirez. Also, the aluminum layer is eliminated and charge is deposited on both sides of the imaging member. Positive charge of about 0.2 microcoulombs/per $cm^2$ is deposited on the migration layer and simultaneously equal quantities of negative charge are deposited on the free Mylar surface. This double sided charging is accomplished using two corotrons. The charged member is exposed and developed as in Example 1. to yield an imaged member which is transparent in nonexposed, migrated areas and bright orange in exposed, non-migrated areas.

EXAMPLE III

An imaging member similar to that in FIGS. 3A and B is formed in the following manner. The substrate is 3 mil paper coated with an approximately 3 micron layer of carbon black forming a black conductive substrate. The circulation layer is made with the n-butyl-methacrylate and polystyrene copolymer which is rendered photoconductive by adding 5 percent by weight alpha phthalocyanine. This mixture is coated onto the substrate to an approximately 10 micron thickness as in Example I. The migration layer is made with "Piccopale H-2" a thermoplastic hydrocarbon resin available from Pennyslvania Industrial Chemical Corporation. The "Piccopale" is dissolved in hexane and submicron titanium dioxide particles are added in a ratio of 2 parts titanium dioxide to 1 part "Piccopale" by weight. This mixture is coated onto the circulation layer as in Example I.

The imaging member has charge deposited on its surface by a corotron to a density of 0.2 microcoulombs/per $cm^2$ which induces equal and opposite charge in the conductive substrate. The uniformly charged member is exposed as in Example I through the "Piccopale" layer except the exposure at the charged surface is approximately 100 foot candle seconds. The charged and exposed member is heat developed by placing it on a hot plate at 250°F for approximately 10 seconds. During the development period substantially all the titanium dioxide particles migrate to the migration layer circulation layer interface because an electric field exists across the entire migration layer but only the particles in the nonexposed areas migrate into the circulation layer toward the substrate because the field across the circulation layer is collapsed in exposed areas. The developed member is a positive reflection image. The accumulated white particles in the nonexposed areas effectively act as a window opening to reveal the black substrate and the exposed areas are substantially unchanged with the white titanium oxide particles still hiding the black substrate. The circulation layer is effectively transparent.

EXAMPLE IV

The imaging member of FIGS. 5A and B is made in the following manner. The imaging member in Example II has an additional outer migration layer coated on the mercuric sulfide migration layer. The outer layer is made with "Nirez" containing phthalocyanine particles of approximately 0.1 to 1 micron diameters in a ratio of 3 parts "Nirez" to 7 parts phthalocyanine by weight. The outer weight layer is coated onto the inner layer in a manner similar to that used to coat the inner layer. The solvent for the outer layer dissolves the binder for the inner layer but the phthalocyanine and mercuric sulfide particles do not mix. The resulting structure includes an outer layer approximately 2 microns thick, an inner layer approximately 2 microns thick, a circulation layer approximately 5 microns thick and a 3 mil substrate.

The imaging member is charged and exposed as in Example II. Vapor development is used in this case. The member is exposed to trichloroethylene vapors for about 15 seconds. After development, in nonexposed areas the phthalocyanine and mercuric sulfide particles are accumulated in groups at the substrate with the phthalocyanine covered by the mercuric sulfide particles. The particles in the exposed areas in both migration layers are substantially unchanged in position.

The developed member, when viewed and illuminated from the outer layer side, appears blue in exposed areas and a dull red in the nonexposed areas. When viewed and illuminated from the "Mylar" side, the member appears a dull red in exposed areas and blue in nonexposed areas.

The developed member, when viewed from the outer side and illuminated from the "Mylar" side or vice versa, transmits light in the nonexposed areas between the accumulated particles meaning that the optical density of the member is reduced in the nonexposed areas.

EXAMPLE V

The imaging member of Example I is coated with a protective layer of "Nirez" approximately 1 micron thick. Images are formed with this member by charging, exposing and developing steps as in Example I. The coated members exhibit no substantial change in imaging characteristics over a period of about 1.5 years.

EXAMPLE VI

The imaging member of Example III is made without the alpha phthalocyanine in the circulation layer. The electrical latent image is created by grounding the substrate and by positioning a conductive stencil close to the migration layer. A potential of about +600 volts is coupled to the stencil and the areas of the imaging member exposed by the stencil are charged with a corotron to a potential near +600 volts. This charged member is developed as in Example III yielding particle migration in the charged areas.

EXAMPLE VII

A second imaging member of the type depicted in FIGS. 5A and B is prepared as follows. A 3 mil "Mylar" film. available from E. I. DuPont is used as the substrate. A layer of a copolymer of n-butyl-methacrylate and polystyrene containing 5 percent dibutylphthalate is cast from a xylene solution to form an approximately 5 micron thick layer coating the substrate. A first migration layer is made with a polyterpene resin, available from Tenneco Corp. under the trademark, "Nirez 1085." A migration layer containing about 3 parts "Nirez" and about 1 part phthalocyanine particles of from about 0.1 to 1 microns is cast from a kerosene solution onto the previous copolymer coating and is about 1 micron thick. A second migration layer is coated upon the first migration layer and is made in the same manner as the first migration layer except that the second migration layer contains 4 parts by weight titanium dioxide ($TiO_2$) as migration marking particles and about 6 parts by weight "Nirez 1085, " and is about 1 micron thick. As mentioned in Example IV, the marking materials do not mix even though coated from the same solvents.

The imaging member is charged to a field strength of about 50 volts/micron using a double corona unit. This unit simultaneously sprays negative charges on the Mylar side of the member and positive charges on the $TiO_2$ side of the member. The member is exposed as in Example I and developed by contacting with trichlorethylene vapors for about 15 seconds.

Inversion of the marking particles is observed after development. Grouping of marking particles, circulation of the copolymer layer, frosting, and "window opening" or decrease in optical transmission density are not observed. Viewed from the Mylar side of the member, the phthalocyanine particles are visible in exposed areas and the $TiO_2$ particles in nonexposed areas. Conversely, when viewed from the $TiO_2$ side of the structure, the $TiO_2$ particles are visible in exposed areas and the phthalocyanine particles are visible in the nonexposed areas.

EXAMPLE VIII

Example VII is repeated with the following differences: the copolymer layer coated upon the substrate additionally includes Piccotex 100, available from the Pennsylvania Industrial Chemical Co., so that the copolymer layer has about 10 parts by weight copolymer, about 10 parts by weight Piccotex 100 and about 1 part by weight dibutylphthalate; development is for about 10 seconds. Similar results are obtained as are obtained in Example VII.

EXAMPLE IX

Example VII is repeated except that the layer coated upon the substrate is about 100 percent Piccotex 100 instead of the copolymer of n-butyl-methacrylate and polystyrene. The migration layers of Example VII tend to diffuse into the 100 percent Piccotex coating and therefore a different fabrication technique is utilized. The substrate and Piccotex coating are heated to about 60°C and the first migration layer is coated onto a Tedlar substrate and subsequently transferred from the Tedlar to the heated Piccotex layer. Transfer occurs upon contacting the two layers and peeling away the Tedlar. The substrate, Piccotex layer and first migration layer are similarly heated to 60°C and the second migration layer, previously coated onto a Tedlar substrate, is similarly transferred to atop the first migration layer. The thus fabricated imaging member is contacted with trichloroethylene vapors for about 10 seconds. Similar results as those of Example VII are obtained.

EXAMPLE X

The member 1 of FIG. 1 is prepared by following Example I in order to coat the circulation layer therein upon an approximately 5 mil thick aluminum substrate. The structure is oven dried at about 100°C for about 1.5 hours and removed from the oven. Example I is then followed in order to coat the circulation layer therein onto the circulation layer but which migration layer contains about 85 percent "Nirez" and about 15 percent phthalocyanine and is about 3 microns thick upon drying in an oven for about ½ hour at 100°C. The structure is charged with negative charge to a value of about 0.2 microcoulombs/$cm^2$ in the manner disclosed in Example I and exposed to radiation as in Example I. The development, however, is carried out by washaway by immersing the charged and exposed structure in toluene for about 1 to 2 seconds. The "Nirez" layer is removed and the circulation layer is softened. A negative to positive image is obtained; that is, where the original was dark the imaged structure is silver and where the original was light the imaged structure is blue.

EXAMPLE XI

Example X is followed except that the charge deposited is of positive polarity. A positive to positive image is obtained; that is, where the original was dark or light the imaged structure is also dark or light, respectively. A comparison of the images obtained in Example X and here show that they are in the reverse sense one to the other. Where the Example X image is blue, the present image is silver and vice versa.

EXAMPLE XII

The imaging member 1 of FIG. 1 is prepared by following Example VII in order to coat a circulation layer, about 5 microns thick, of the copolymer therein and Piccotex 100 in about a 1:1 ratio, upon an about 3 mil "Mylar" film substrate. The phthalocyanine - "Nirez" migration layer of Example VII is coated over the circulation layer and the structure is charged by a double corona unit as in Example VII. The structure is exposed and developed as in Example I. The structure, after imaging, bears a low contrast image of blue on blue with some transparentizing appearing in non-exposed, migrated areas.

The structure is placed in contact with an about 3 mil thick "Mylar" receiving sheet at its migration layer side while the structure is still in its softened state. Upon separation of the two "Mylar" sheets; i.e., substrate and receiving sheet, the circulation layer is split near its interface with the migration layer, yielding a negative of the original on the receiving sheet and a positive of the original on the substrate. The substrate with its split portion has a light sky blue in background areas and a dark blue image. The receiving sheet with its split portion has a dark blue background and clearly transparent image.

EXAMPLE XIII

Example XII is repeated except that the imaged structure is allowed to resume its normal non-softened state prior to splitting. Splitting is achieved by passing the structure in contact with the receiving sheet through a pair of heated rollers in intimate contact and at about 95°C. The substrate and receiver sheet are separated while the structure is in its heated and softened state, with results similar to those of Example XII.

EXAMPLE XIV

The imaging member of FIGS. 5A and 5B is made as follows:

The substrate is prepared with about a 2 mil "Kodar" film, available from Eastman Kodak Company, vacuum coated with a thin layer of aluminum that forms an opaque highly reflective conductor. The circulation layer comprises about a 1:1 mixture of a copolymer of n-butyl-methacrylate and polystyrene and Piccotex 100, dissolved in toluene. The solution is coated onto the aluminum layer to yield approximately a 4 micron layer upon drying.

A first migration layer is coated upon the circulation layer, is about 1 micron thick upon drying and comprises about 2 parts phthalocyanine particles in about 3 parts Nirez 1085.

A second migration layer is made by dissolving about 1 part Nirez 1085 in Sohio Odorless Solvent 3440 and adding about 4 parts HgS particles. The resulting dispersion is coated upon the first migration layer to yield a thickness of about 1 micron upon drying.

The imaging member has negative charge deposited on the surface of the second migration layer which creates an electrical field strength across the three layers of about 50 volts per micron, using a corotron described by Vyverberg in U.S. Pat. No. 2,836,725. The charged surface is exposed through a positive transparency to a 75 Watt lamp at *f*/32 for about 0.5 seconds.

The charged and exposed member is subjected to trichloroethylene vapors for about 5 seconds thereby softening the three layers and allowing the particles to migrate in exposed areas. The developed image when viewed from the migration layers side appears a dull reddish brown in exposed, non-migrated areas and appears black in non-exposed, migrated areas, indicating inversion of the particles. Viewed from the substrate side, the developed image appears dark blue in exposed, non-migrated areas and appears dark tan in non-exposed, migrated areas; again indicating inversion. In all areas of migration, a reduction in optical transmission density is observed; indicating grouping of the inverted, migrated particles.

EXAMPLE XV

Example XIV is followed except that the first and second migration layers of XIV are the second and first migration layers respectively in the present example and exposure is through a negative original at *f*/11 for about 2.5 seconds. The developed image when viewed from the migration layers side appears black in exposed, nonmigrated areas and a medium brown in nonexposed, migrated areas. Viewed from the substrate side, the developed image appears light brownish-orange in exposed, nonmigrated areas and a very dark brown in nonexposed, migrated areas. Inversion and transparentizing are noted.

EXAMPLE XVI

Example XIV is followed except that: the first migration layer contains about a 1:1 ratio mixture of about 2 parts phthalocyanine particles in about 3 parts Nirez 1085 and about 4 parts CdSSe in about 1 part Nirez 1085; the second migration layer contains about 4 parts ZnO in Nirez 1085; the exposure is at *f*/22 for about 1 second. From the migration layers side after development, the image appears chalky grey in exposed, nonmigrated areas and black in nonexposed, migrated areas. From the substrate side, the image appears rich brown in exposed, nonmigrated areas and grey in nonexposed, migrated areas. Inversion and transparentizing is observed.

EXAMPLE XVII

Example XVI is followed except that the first migration layer contains only the phthalocyanine particles of Example XVI. The grey black and brown colors of XVI and now different shades of blue in this example. Inversion and transparentizing is observed.

EXAMPLE XVIII

Example XVII is followed except that the second migration layer contains about 80 percent particles of N-2″-pyridyl-8, 13-dioxodinaphtho-(2,1-*b;* 2′, 3′-*d*)-furan-6-carboxamide, instead of the about 80 percent ZnO. From the migration layers side, the developed member appears light green in exposed, nonmigrated areas and dark green in nonexposed, migrated areas. From the substrate side, the member appears dark green in exposed, nonmigrated areas and very light green in nonexposed migrated areas. Inversion and transparentizing is observed.

EXAMPLE XIX

Example XVI is followed except that the second migration layer contains about 80 percent $TiO_2$ instead of about 80 percent ZnO. Viewed from the migration layers side, the developed member appears a grayish white in exposed, nonmigrated areas and a black in nonexposed, migrated areas. The member, when viewed from the substrate side, appears dull brown in exposed, nonmigrated areas and grey in nonexposed, migrated areas. Inversion and transparentizing is observed.

EXAMPLE XX

Example I is followed to prepare an imaging member having a card stock plastic filled paper painted with a conductive silver material named "G. C. Silver Paint" by and available from G. C. Electronics of Rockford, Illinois. The copolymer circulation layer is coated on the silver free side of the paper and dries at about 4 microns in thickness. The migration layer contains 15 percent phthalocyanine particles, is coated on the circulation layer and has a dried thickness of about 2 microns. Charging, exposing and development is as in Example I. After development, the member on the migration layer side is blue in exposed, nonmigrated areas and grey in nonexposed, migrated areas.

EXAMPLE XXI

Example XX is followed and after development, the "Nirez" is removed from the migration layer by immersion in Sohio Odorless Solvent 3440. The image appears dull blue in formerly grey areas and white in formerly blue areas.

EXAMPLE XXII

Example XX is successfully followed except that the circulation layer is made with a custom synthesized about 80/20 mole percent copolymer of styrene and hexylmethacrylate having an intrinsic viscosity of about 0.179 dl. /gm.

EXAMPLE XXIII

Example XX is successfully followed except that the migration layer contains about 15 percent of a trimix of about 2 parts ammonia washed phthalocyanine, about 1 part purified Algol Yellow, available from General Dye Stuffs, and about 1 part purified Irgazine Red, available from Geigy Chemical Corp.; ball milled for about 4 hours at 60 RPM with the ball-mill jar being 1¼ gallon in capacity and half filled with flint stones from about ⅝ inch to ¾ inch in diameter.

Charging and developing in all the above Examples, with the exception of Example VI, are carried out in the absence of activating radiation for the photoconductive layers.

Other modifications and ramifications of the present invention will occur to those skilled in the art upon a reading of the disclosure; including various changes to the details, materials, steps and arrangement of parts which have been herein described. These are intended to be included within the scope of this invention. It may be that other substances exist or may be discovered that have some or enough of the properties of the particular substances described herein and may be suitable for use in their place; these too are intended to be included within the principal and scope of the invention. One modification is to make the circulation and/or deformation referred to herein to occur in a well ordered and defined pattern. This may be accomplished by various mechanical, electrical and/or optical (i.e. by screened exposure) techniques disclosed in U.S. Pat. No. 3,436,216 and two separate copending applications of Lloyd F. Bean and John Heurtley, each filed on or about Sept. 19, 1970 and having the same title "Method of Organized Thermoplastic Xerography and Photoreceptor Structure Therefor." Broadly, the technique is to modulate the electric field across a frostable material spacially related to the natural special response of the material. The charge densities capable of initiating circulation and/or deformation may be below the normal respective threshold values for circulating or deforming the member. Consequently, the charge of the electrical latent image employed in the present invention should be "capable of circulating and/or deforming" means that the charge density is above the respective threshold level, spacially modulated and/or otherwise effectively employed.

While only two migration layers have been discussed herein in detail with respect to the multiple migration layer embodiment of this invention, it will be understood that three or more migration layers can be employed in the practice of this invention.

Although marking particles rendering a visible and colored image have been primarily discussed, it will be appreciated that any particles capable of migrating in the process herein described may be used to create images irrespective of visibility and color. For example, $Fe_2O_3$ particles may be used to create an image which can be magnitized and used in magnetic sensing automatic data processing systems, identification systems, etc. Conductive particles may be used to create electrical connections between electronic components for example, as in a printed circuit. Hydrophilic particles may be used for producing lithographic masters, and so forth.

While development has been described with emphasis so softening by heat, vapor or solvent, it will be understood that wash-away development as mentioned to a lesser extent is entirely satisfactory; that furthermore, any softening influence which decreases the resistance to migration of migration particles in depth in the softenable layers of the imaging member can be successfully used.

It will be understood and appreciated that while we have spoken of binder and layer configurations for the migration particles in the migration layers in terms of migrating in exposed areas for the layer configuration and migrating in unexposed areas for the binder configuration, that reference to the applications on page 2 hereof will reveal materials which will cause migration in the above configuration opposite to that set out above.

Finally, while we have spoken primarily of circulation within the circulation layer and having a grouping effect at some point upon migrating particles in the migration layer, it will be appreciated that the softenable migration layers can also be sufficiently reduced in viscosity during the development, if desired, to extend the circulation to throughout one or more migration layers. This may be desired, for example, when the primary object is to obtain bulk mixing of two or more layers in order to achieve some desired effect such as a change in physical or chemical property that is distinct from either layer in unmixed areas.

What is claimed is:

1. An imaging member, comprising:

a. a first layer of softenable material;

b. a second layer having softenable material and migration material; and c. at least a third layer having softenable material and migration material; said second layer being sandwiched between said first and third layers, and said softenable materials in said first, second and third layers capable of having their resistance to migration of migration material decreased sufficiently to allow migration in depth in said first, second and third layers of said migration materials in said second and third layers.

2. The imaging member of claim 1 further including a substrate adjacent said first layer of softenable material.

3. The imaging member of claim 2 wherein said substrate comprises paper.

4. The imaging member of claim 1 wherein said first layer softenable material and said second layer softenable material are immiscible.

5. The imaging member of claim 1 wherein said first layer of softenable material comprises a frostable material.

6. The imaging member of claim 1 wherein said first layer of softenable material is a colored layer.

7. The imaging member of claim 1 wherein said second layer having softenable material and migration material is a colored layer.

8. The imaging member of claim 1 wherein said third layer having softenable material and marking material is a colored layer.

9. The imaging member of claim 1 wherein at least one of said second and third layers has its respective migration material dispersed as particles throughout the bulk of its respective softenable material.

10. The imaging member of claim 1 wherein at least one of said second and third layer has its respective migration material substantially layered in its respective softenable material.

11. The imaging member of claim 10 wherein said substantially layered marking material includes photosensitive particles.

12. The imaging member of claim 1 further including an insulating transparent protective layer on said third layer.

13. An imaged member, comprising:

a. a layer of softenable material; and b. and image within said softenable material layer comprising migrated first and second migration materials the relative positioning of which, one to the other, is inverted with respect to their relative positioning prior to imaging.

14. The imaged member of claim 13 further including a substrate adjacent said softenable material layer.

15. The imaged member of claim 14 wherein said substrate comprises paper.

16. The imaged member of claim 13 wherein said first and second migration materials are each of a different color.

17. The imaged member of claim 13 further including a second layer having softenable material and migration material.

18. The imaged member of claim 17 further including at least a third layer having softenable material and migration material with said second layer being sandwiched between said first and third layers.

19. The imaged member of claim 18 wherein at least one of said second and third layers are photoconductive.

20. The imaged member of claim 13 wherein said migrated second marking material covers said migrated first marking material.

21. The imaged member of claim 20 wherein said migrated second and first marking materials are accumulated into groups.

22. The imaged member of claim 18 wherein the image is a positive reflection image.

23. The imaged member of claim 18 wherein the image is a negative reflection image.

24. The imaged member of claim 18 wherein the migrated second and first marking materials are accumulated into groups and wherein said image is a negative transparency.

25. The imaged member of claim 13 wherein said layer of softenable material has a thickness of from about 1 micron to about 12 microns.

26. The imaged member of claim 20 wherein said softenable material layer thickness is from about 1 micron to about 5 microns.

27. The imaged member of claim 18 wherein either of said second and third layers have a thickness of from about 0.5 micron to about 5 microns.

28. The imaged member of claim 27 wherein said either second and third layer thickness is from about 0.5 micron to about 2 microns.

29. The imaged member of claim 18 wherein the volume ratio in either of said second and third layers of migration material to softenable material is from about 1:8 to about 7:1.

30. The imaged member of claim 18 wherein the weight ratio in either of said second and third layers of migration material to softenable material is from about 1:6 to about 4:1.

31. The imaged member of claim 13 wherein either of said first and second migration materials comprises particles having average particle diameters of from about 0.1 micron to about 1 micron.

32. The imaged member of claim 18 wherein said migration material in either of said second and third layers includes the complementary image of said image within said layer of softenable material.

* * * * *